US011339026B2

(12) United States Patent
Hu

(10) Patent No.: US 11,339,026 B2
(45) Date of Patent: May 24, 2022

(54) SYSTEM FOR PROCESSING PRESSURE SENSOR DATA

(71) Applicant: Otis Elevator Company, Farmington, CT (US)

(72) Inventor: Guohong Hu, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 414 days.

(21) Appl. No.: 15/823,686

(22) Filed: Nov. 28, 2017

(65) Prior Publication Data

US 2019/0161320 A1 May 30, 2019

(51) Int. Cl.

| | |
|---|---|
| ***B66B 1/34*** | (2006.01) |
| ***B66B 5/00*** | (2006.01) |
| ***B66B 3/00*** | (2006.01) |
| *B66B 5/18* | (2006.01) |

(52) U.S. Cl.

CPC ..... *B66B 5/0025* (2013.01); *B66B 1/34* (2013.01); *B66B 3/002* (2013.01); *B66B 5/18* (2013.01)

(58) Field of Classification Search

USPC ..... 187/390

See application file for complete search history.

(56) References Cited

U.S. PATENT DOCUMENTS

| | | | | |
|---|---|---|---|---|
| 4,592,270 | A | 6/1986 | Vener | |
| 5,979,607 | A | 11/1999 | Allen | |
| 6,522,252 | B2 | 2/2003 | Horibe et al. | |
| 7,946,392 | B2 | 5/2011 | Rotboll | |
| 2004/0222048 | A1* | 11/2004 | Mizuno | B66B 11/024 187/401 |
| 2010/0130118 | A1* | 5/2010 | Lee | F24F 7/10 454/195 |
| 2011/0240414 | A1 | 10/2011 | Carreno et al. | |
| 2017/0251178 | A1* | 8/2017 | Kawamoto | H04N 7/183 |
| 2018/0283727 | A1* | 10/2018 | Grabon | B66B 11/0005 |

FOREIGN PATENT DOCUMENTS

| | | | |
|---|---|---|---|
| CN | 201129014 | U | 10/2008 |
| CN | 202328674 | U | 7/2012 |
| CN | 105712134 | A | 6/2016 |
| CN | 106144865 | A | 11/2016 |
| JP | 07267543 | A | 10/1995 |

(Continued)

OTHER PUBLICATIONS

The Extended European Search Report for Application No. 18208448.3-1017; Report dated: Jul. 2, 2019; Report Received Date: Jul. 11, 2019; 9 pages.

*Primary Examiner* — Christopher Uhlir

(74) *Attorney, Agent, or Firm* — Cantor Colburn LLP

(57) ABSTRACT

A method of detecting maintenance requirements of a system for conveying a car through a passageway is provided. The method comprising: detecting pressure data for at least one or more locations along a passageway using a pressure sensor; comparing the pressure data to benchmark pressure data for each of the one or more locations; determining a pressure data variance at a first location of the one or more locations in response to the pressure data and the benchmark pressure data; and identifying an identity of a car stop location door system located at the first location when the pressure data variance is greater than a selected tolerance.

18 Claims, 5 Drawing Sheets

(56) References Cited

FOREIGN PATENT DOCUMENTS

| | | | |
|---|---|---|---|
| JP | 2001120674 | A | 5/2001 |
| JP | 2004224532 | A | 8/2004 |
| JP | 2012180135 | A | 9/2012 |
| KR | 20050037819 | A | 4/2005 |
| WO | 2007075161 | A1 | 7/2007 |
| WO | 2017016937 | A1 | 2/2017 |

* cited by examiner

SYSTEM FOR PROCESSING PRESSURE SENSOR DATA

BACKGROUND

The subject matter disclosed herein relates generally to the field of elevator systems, and specifically to a method and apparatus for detecting repair requirements in elevator systems.

Some physical components of an elevator car may require a physical inspection by an elevator technician in order to determine if a repair is required. Physical inspections may occur at a specific interval or at the request of the owner/operator of the elevator system.

BRIEF SUMMARY

According to one embodiment, a method of detecting maintenance requirements of a system for conveying a car through a passageway is provided. The method comprising: detecting pressure data for at least one or more locations along a passageway using a pressure sensor; comparing the pressure data to benchmark pressure data for each of the one or more locations; determining a pressure data variance at a first location of the one or more locations in response to the pressure data and the benchmark pressure data; and identifying an identity of a car stop location door system located at the first location when the pressure data variance is greater than a selected tolerance.

In addition to one or more of the features described above, or as an alternative, further embodiments may include that the detecting the method further comprises: moving a car through the passageway, wherein a pressure sensor is located on the car.

In addition to one or more of the features described above, or as an alternative, further embodiments may include that the moving occurs simultaneous to the detecting.

In addition to one or more of the features described above, or as an alternative, further embodiments may include activating an alarm in response to identifying the car stop location door system.

In addition to one or more of the features described above, or as an alternative, further embodiments may include identifying a plurality of locations having equivalent pressure variances.

In addition to one or more of the features described above, or as an alternative, further embodiments may include adjusting air pressure in the passageway in response to the pressure data variance.

In addition to one or more of the features described above, or as an alternative, further embodiments may include transmitting at least one of the pressure data variance and the identity to a user device.

According to another embodiment, a method of detecting maintenance requirements of an elevator system is provided. The method comprising: detecting pressure data for at least one or more locations along an elevator hoistway using a pressure sensor; comparing the pressure data to benchmark pressure data for each of the one or more locations; determining a pressure data variance at a first location of the one or more locations in response to the pressure data and the benchmark pressure data; and identifying an identity of an elevator landing door system located at the first location when the pressure data variance is greater than a selected tolerance.

In addition to one or more of the features described above, or as an alternative, further embodiments may include that the detecting the method further comprises: moving an elevator car through the elevator hoistway, wherein a pressure sensor is located on the elevator car.

In addition to one or more of the features described above, or as an alternative, further embodiments may include that the moving occurs simultaneous to the detecting.

In addition to one or more of the features described above, or as an alternative, further embodiments may include activating an alarm in response to identifying the elevator landing door system.

In addition to one or more of the features described above, or as an alternative, further embodiments may include identifying a plurality of locations having equivalent pressure variances.

In addition to one or more of the features described above, or as an alternative, further embodiments may include adjusting air pressure in the hoistway in response to the pressure data variance.

In addition to one or more of the features described above, or as an alternative, further embodiments may include transmitting at least one of the pressure data variance and the identity to a user device.

According to another embodiment, a controller for an elevator system, the controller comprising: a processor; and a memory comprising computer-executable instructions that, when executed by the processor, cause the processor to perform operations, the operations comprising; detecting pressure data for at least one or more locations along an elevator hoistway using a pressure sensor; comparing the pressure data to benchmark pressure data for each of the one or more locations; determining a pressure data variance at a first location of the one or more locations in response to the pressure data and the benchmark pressure data; and identifying an identity of an elevator landing door system located at the first location when the pressure data variance is greater than a selected tolerance.

In addition to one or more of the features described above, or as an alternative, further embodiments may include that the detecting the method further comprises: moving an elevator car through the elevator hoistway, wherein a pressure sensor is located on the elevator car.

In addition to one or more of the features described above, or as an alternative, further embodiments may include that the moving occurs simultaneous to the detecting.

In addition to one or more of the features described above, or as an alternative, further embodiments may include that the operations further comprise: activating an alarm on a user device in response to identifying the elevator landing door system.

In addition to one or more of the features described above, or as an alternative, further embodiments may include that the operations further comprise: identifying a plurality of locations having equivalent pressure variances.

In addition to one or more of the features described above, or as an alternative, further embodiments may include that the operations further comprise: adjusting air pressure in the hoistway in response to the pressure data variance.

Technical effects of embodiments of the present disclosure include utilizing air pressure measurements within passageways of a system for conveying a car through a passageway to determine maintenance requirements on the system.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
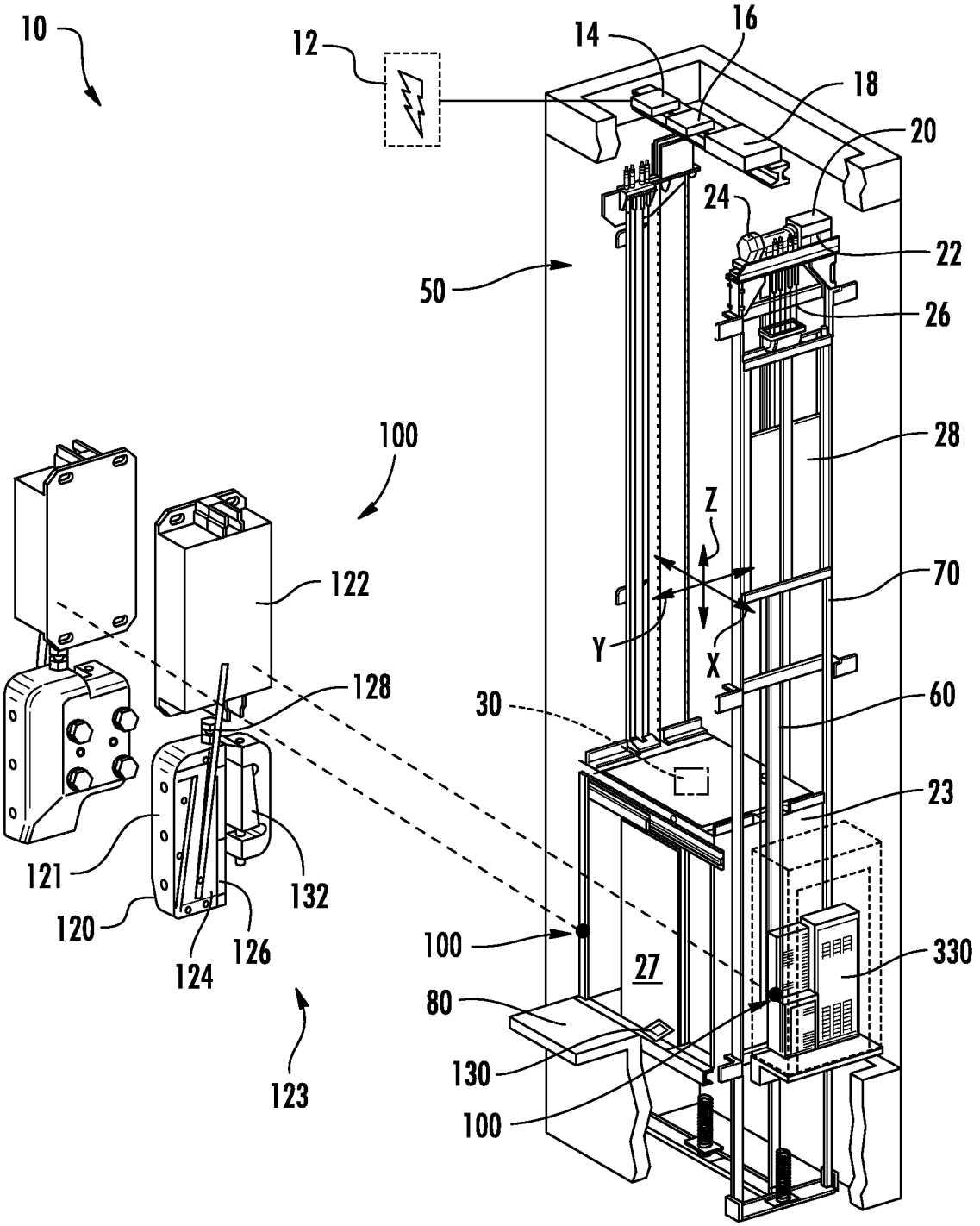
FIG. 1 illustrates a schematic view of an elevator system, in accordance with an embodiment of the disclosure.

FIG. 1 shows a schematic view of an elevator system 10, in accordance with an embodiment of the disclosure. With reference to FIG. 1, the elevator system 10 includes an elevator car 23 configured to move vertically upward and downward within a hoistway 50 along a plurality of car guide rails 60. The elevator system 10 may also include a counterweight 28 operably connected to the elevator car 23 via a pulley system 26. The counterweight 28 is configured to move vertically upward and downward within the hoistway 50. In addition, elevator systems moving laterally and/or diagonally may also be used. In one embodiment, the elevator car 23 may move laterally. In another embodiment, the elevator car 23 may move diagonally. The counterweight 28 moves in a direction generally opposite the movement of the elevator car 23, as is known in conventional elevator systems. Movement of the counterweight 28 is guided by counterweight guide rails 70 mounted within the hoistway 50. The elevator car 23 also has doors 27 to open and close, allowing passengers to enter and exit the elevator car 23 at a floor 80.

The elevator system 10 also includes a power source 12. The power is provided from the power source 12 to a switch panel 14, which may include circuit breakers, meters, etc. From the switch panel 14, the power may be provided directly to the drive unit 20 through the controller 330 or to an internal power source charger 16, which converts AC power to direct current (DC) power to charge an internal power source 18 that requires charging. For instance, an internal power source 18 that requires charging may be a battery, capacitor, or any other type of power storage device known to one of ordinary skill in the art. Alternatively, the internal power source 18 may not require charging from the AC external power source 12 and may be a device such as, for example a gas powered generator, solar cells, hydroelectric generator, wind turbine generator or similar power generation device. The internal power source 18 may power various components of the elevator system 10 when an external power source is unavailable. The drive unit 20 drives a machine 22 to impart motion to the elevator car 23 via a traction sheave of the machine 22. The machine 22 also includes a brake 24 that can be activated to stop the machine 22 and elevator car 23. As will be appreciated by those of skill in the art, FIG. 1 depicts a machine room-less elevator system 10, however the embodiments disclosed herein may be incorporated with other elevator systems that are not machine room-less or that include any other known elevator configuration. In addition, elevator systems having more than one independently operating elevator car in each elevator shaft and/or ropeless elevator systems may also be used. In one embodiment, the elevator car may have two or more compartments.

The controller 330 is responsible for controlling the operation of the elevator system 10. The controller 330 may include a processor and an associated memory. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

Each elevator car 23 may include a dedicated elevator car controller 30 that is responsible for controlling the operation of the elevator car 23. The controller 30 of the elevator car 23 is in electronic communication of the controller 330 of the elevator system 10. The controller 30 may include a processor and an associated memory. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

FIG. 1 also illustrates a brake assembly 100 for an elevator system 10. The brake assembly may be operable to assist in braking (e.g., slowing or stopping movement) of the elevator car 23. The brake assembly 100 may be in electronic communication with the controller 30. In one embodiment, the braking is performed relative to the guide rail 60. The brake assembly 100 can be used with various types of elevator systems. The brake assembly 100 includes a safety brake 120 and an electronic safety actuator 122 that are each operatively coupled to the elevator car 23. In some embodiments, the safety brake 120 and the electronic safety actuator 122 are mounted to a car frame of the elevator car 23. The safety brake 120 includes a safety wedge system 123, such as a brake pad or a similar structure suitable for repeatable braking engagement, with the guide rail 60 and safety wedge system 123. The safety wedge system 123 has a contact surface 126 that is operable to frictionally engage the guide rail 60. In one embodiment, the safety brake 120 and an electronic safety actuator 122 may be combined into a single unit. In a non-limiting example, FIG. 1 shows an instance of safety brake 120 that has a safety wedge system 123 which has sliding wedge 124, and releasing wedge 132. When the safety brake 120 is actuated the sliding wedge 124 and the releasing wedge 132 perform the braking function. During actuation of the safety brake 120, the sliding wedge 124 is lifted along predefined path toward the guide rail 60 until it makes full contact with the guide rail 60 and the elevator car 23 is subsequently forced to move horizontally (i.e., Y direction in FIG. 1). After a running clearance between the sliding wedge 124 and the guide rail 60 is reduced to zero, the releasing wedge 132 makes full contact with the guide rail 60. During safety reset, the elevator car 23 moves up and each of the releasing wedge 132 and the sliding 124 move down relative to a housing 121 of the safety brake 120. It is understood that other safety wedge systems 123 may be used. For example, a symmetric safety wedge system 123 that is composed of two sliding wedges rather than one sliding and one releasing wedge may be used. A mechanism may be used to connect both sliding wedges for actuation/reset.

The safety brake 120 is operable between a non-braking position and a braking position. The non-braking position is a position that the safety brake 120 is disposed in during normal operation of the elevator car 23. In particular, the contact surface 126 of the safety wedge system 123 is not in contact with, or is in minimal contact with, the guide rail 60 while in the non-braking position, and thus does not frictionally engage the guide rail 60. In the braking position, the frictional force between the contact surface 126 of the safety wedge system 123 and the guide rail 60 is sufficient to stop movement of the elevator car 23 relative to the guide rail 60. Various triggering mechanisms or components may be employed to actuate the safety brake 120 and thereby move the contact surface 126 of the safety wedge system 123 into frictional engagement with the guide rail 60. In the illustrated embodiment, a link member 128 is provided and couples the electronic safety actuator 122 and the safety brake 120. Movement of the link member 128 triggers movement of the safety wedge system 123 of the safety brake 120 from the non-braking position to the braking position.

In operation, an electronic sensing device and/or a controller 30 is configured to monitor various parameters and conditions of the elevator car 23 and to compare the monitored parameters and conditions to at least one predetermined condition. In one embodiment, the predetermined condition comprises speed and/or acceleration of the elevator car 23. In the event that the monitored condition (e.g., over-speed, over-acceleration, etc.) meets the predetermined condition, the electronic safety actuator 122 is actuated to facilitate engagement of the safety brake 120 with the guide rail 60. In some embodiments, the electronic safety actuator 122 is in electronic communication with a pressure sensor 130 configured to detect pressure data 386 within the elevator shaft 50. The electronic safety actuator 122 may be in electronic communication with a pressure sensor 130 through the controller 30. In one embodiment, the electronic safety actuator 122 may be in direct or indirect electronic communication with the pressure sensor 130. The pressure sensor 130 may be located on a bottom of the elevator car 23 or at any other desired location in or on the elevator car 23. The pressure data 386 is analyzed by the controller 30 and/or the electronic safety actuator 122 to determine if there is an overspeed or over acceleration condition. If such a condition is detected, the electronic safety actuator 122 activates, thereby pulling up on the link member 128 and driving the contact surface 126 of the safety wedge system 123 into frictional engagement with the guide rail 60—applying the brakes. In some embodiments, the electronic safety actuator 122 sends this data to the elevator controller 30 and the controller 30 sends it back to the electronic safety actuator 122 and tells it to activate.

In an embodiment, two electronic safety actuators 122 (one on each guide rail) are provided and connected to a controller 30 on the elevator car 23 that gets data from the electronic safety actuators 122 and initiates activation of the electronic safety actuators 122 for synchronization purposes. In further embodiments, each electronic safety actuator 122 decides to activate on its own. Still further, one electronic safety actuator 122 may be "smart" and one is "dumb," where the smart electronic safety actuator gathers the speed/acceleration data and sends a command to the dumb one to activate along with the smart electronic safety actuator.

Figure 2B:
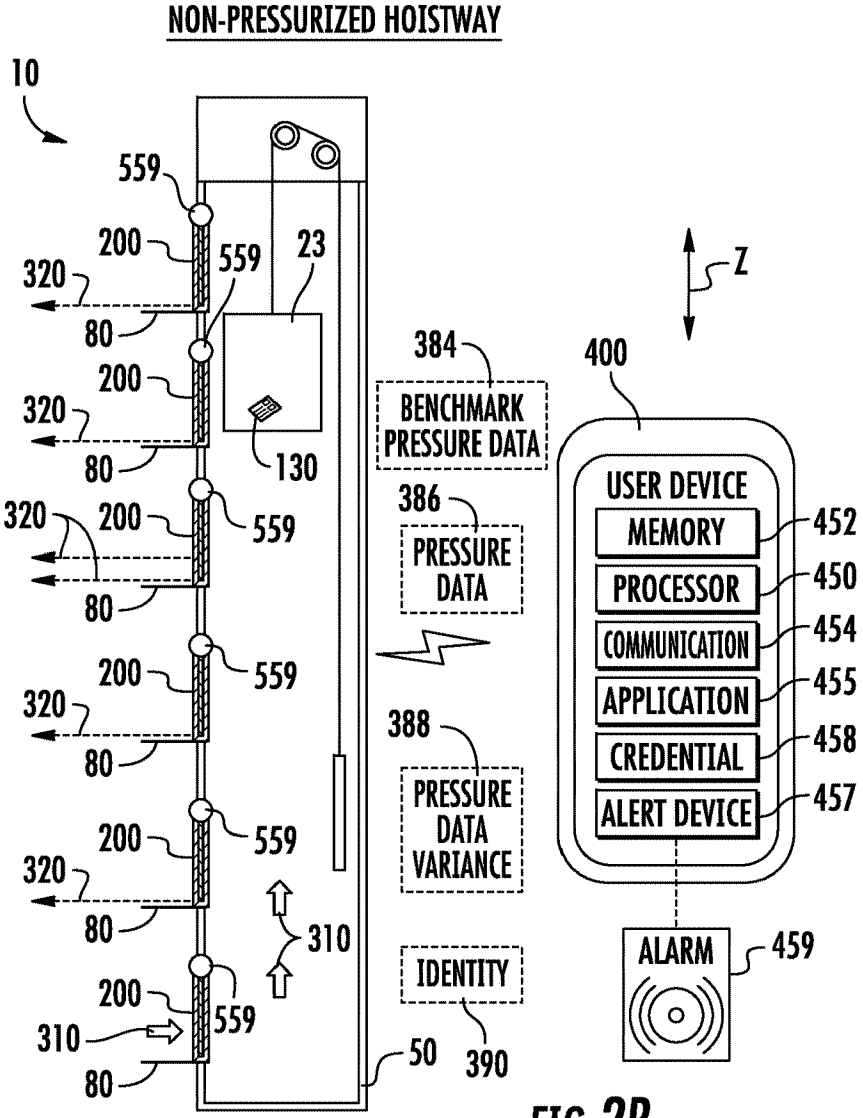
FIG. 2*b* illustrates a schematic view of an elevator system having a non-pressurized hoistway, in accordance with an embodiment of the disclosure.
Figure 2A:
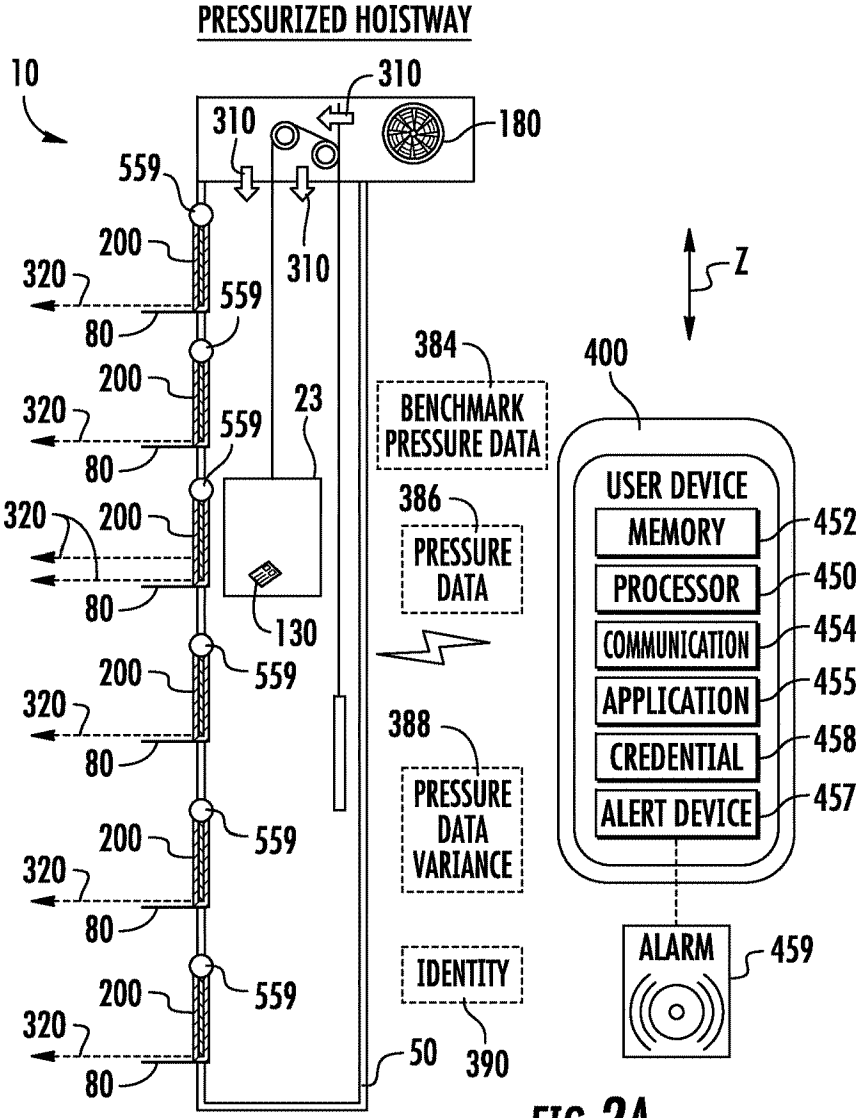
FIG. 2*a* illustrates a schematic view of an elevator system having a pressurized hoistway, in accordance with an embodiment of the disclosure.

Referring now to FIGS. 2*a* and 2*b*, with continued reference to FIG. 1. FIG. 2*a* illustrates an elevator system 10 in an elevator hoistway 50 that is pressurized and FIG. 2*b* illustrates an elevator system 10 in an elevator hoistway 50 that is non-pressurized. The elevator hoistways 50 in FIGS. 2*a* and 2*b* each include elevator landing door systems 200 located at each floor 80 (i.e. elevator landing) along the elevator shaft 50. A fan 180 draws air 310 into the elevator hoistway 50 in FIG. 2*a* to create a pressurized environment within the elevator shaft 50. Air 320 may flow out of the hoistway 50 through gaps 292, 294, 296 (See FIGS. 3*a*, 3*b*, 4*a*, 4*b*) in each elevator landing door system 200, as discussed further below. In the non-pressurized environment of FIG. 2*b*, air 310 may flow into the elevator hoistway through gaps 292, 294, 296 (See FIGS. 3*a*, 3*b*, 4*a*, 4*b*) typically, from the bottom floor(s) elevator landing door system 200. The pressure sensor 130 is configured to detect pressure data 386 at various locations throughout the elevator shaft 50. The detected pressure data 386 is then compared to benchmark pressure data 384 to determine a pressure data variance 388. Benchmark pressure data 384 may be previously measured pressure data 386 established as a standard for the hoistway 50 or a calculated set of pressure data established as a standard for the hoistway 50. A pressure data variance 388 is a difference greater than a selected tolerance between the pressure data 386 and the benchmark pressure data 384.

A pressure data variance 388 may be indicative of an abnormal pressure zone (an abnormal high pressure zone or an abnormal low pressure zone) at a location within the hoistway 50. An identity 390 of an elevator landing door system 200 where the abnormal pressure zone detected may be identified. In the examples of FIGS. 2*a* and 2*b*, the locations are in the z direction and each location may be associated with an elevator landing door system 200 that is proximate the location. An abnormal high pressure zone may be indicative of a gap 292, 294, 296 (See FIGS. 3*a*, 3*b*, 4*a*, 4*b*) in an elevator landing door system 200 at the location allowing excessive airflow into the hoistway. An abnormal low pressure zone may be indicative of a gap 292, 294, 296 (See FIGS. 3*a*, 3*b*, 4*a*, 4*b*) in an elevator landing door system 200 at the location allowing excessive airflow out of the hoistway 50. The indication of an abnormal pressure zone at an elevator landing door system 200 may activate an alarm, described further below. An alarm 559 may be activated on each floor 80 proximate the elevator landing door system 200. The alarm 559 may be audible and/or visual. The alarm 559 may indicate that the elevator landing door system 200 on the floor 80 is out of service. An alarm 459 may also be activated on a user device 400, described further below.

The indication of an abnormal pressure zone at an elevator landing door system 200 may also be transmitted to a user device 400. For example, the indication of an abnormal pressure zone at an elevator landing door system 200 may be transmitted to a smart phone of an elevator technician, so that the elevator technician may examine the elevator landing door system 200 and check for gaps 292, 294, 296 (See FIGS. 3*a*, 3*b*, 4*a*, 4*b*).

In a pressurized hoistway 50, an indication of an abnormal pressure zone may also be indicative that the fan 180 is either over pressurizing or under pressurizing the hoistway 50. If the fan 180 is over pressurizing or under pressurizing the hoistway, that would be detected by the pressure sensor 130 at multiple floors 80. Two example scenarios are provided below for a pressurized hoistway 50.

In a first example scenario, if systematically high pressure was detected, (e.g. high pressure was detected on each of the top 20 floors of the building), this suggests that the hoistway 50 is likely over-pressurized. If in the first example, the hoistway 50 is not being over pressured, then an abnormal high pressure zone may be indicative of a gap 292, 294, 296 (See FIGS. 3*a*, 3*b*, 4*a*, 4*b*) in an elevator landing door system 200 at a location allowing excessive airflow into the hoistway 50.

In a second example scenario, if a systematically low pressure was detected, (e.g. low pressure was detected on each of the bottom 20 floors of the building), this suggests that the hoistway 50 is likely under-pressurized. If in the second example, the hoistway is not being under-pressurized, then an abnormal low pressure zone may be indicative of a gap 292, 294, 296 (See FIGS. 3*a*, 3*b*, 4*a*, 4*b*) in an elevator landing door system 200 at a location allowing excessive airflow out of the hoistway 50.

The user device 400 may be a computing device such as a desktop computer. The user device 400 may also be a mobile computing device that is typically carried by a person, such as, for example a phone, PDA, smart watch, tablet, laptop, etc. The user device 400 may also be two separate devices that are synced together such as, for example, a cellular phone and a desktop computer synced over an internet connection. The user device 400 may include a processor 450, memory 452 and communication module 454 as shown in FIGS. 2*a* and 2*b*. The processor 450 can be any type or combination of computer processors, such as a microprocessor, microcontroller, digital signal processor, application specific integrated circuit, programmable logic device, and/or field programmable gate array. The memory 452 is an example of a non-transitory computer readable storage medium tangibly embodied in the user device 400 including executable instructions stored therein, for instance, as firmware. The communication module 454 may implement one or more communication protocols as described in further detail herein. The user device 400 is configured to store a unique credential 458 that may be shared with the controller 30 to identify what person may own the user device 400. In a non-limiting example, the user device 400 may belong to a manager, engineer, and/or elevator technician, as mentioned above. The user device 400 may include an alert device 457 configured to activate an alarm 459. In three non-limiting examples, the alert device 457 may be a vibration motor, audio speaker, and/or display screen. The alarm 459 may be audible, visual, haptic, and/or vibratory. The user device 400 may also include an application 455. Embodiments disclosed herein, may operate through the application 455 installed on the mobile computing device 400. A user of the user device 400 may be able to receive alarms 459 and view elevator system 10 information through the application 455 including but not limited to benchmark pressure data 384, detected pressure data 386, pressure data variances 388, and the identity 390.

Figure 3B:
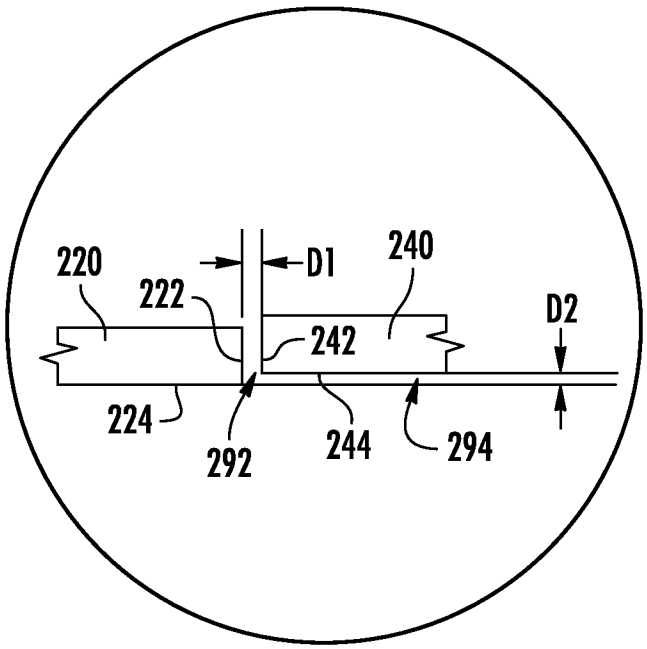
FIG. 3*b* illustrates an enlarged schematic view of the elevator landing door system of FIG. 3*a*, in accordance with an embodiment of the disclosure.
Figure 3A:
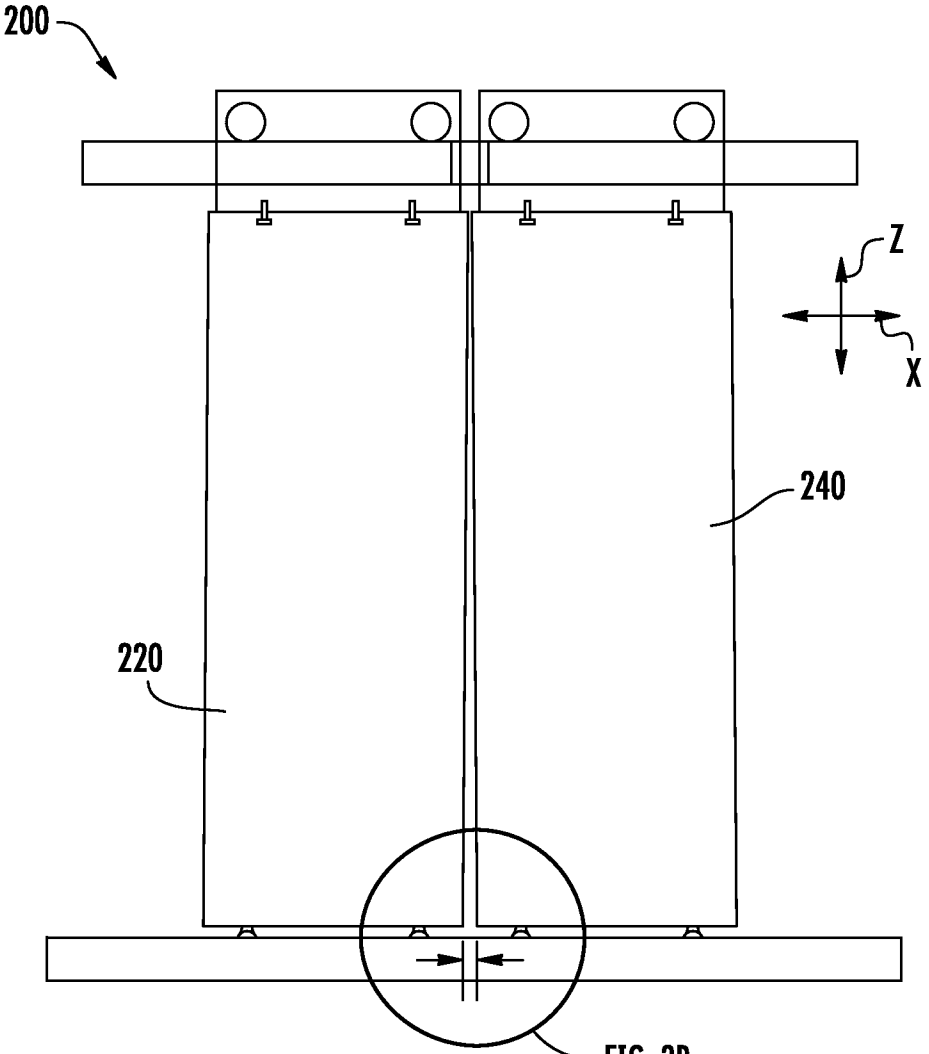
FIG. 3*a* illustrates a schematic view of an elevator landing door system, in accordance with an embodiment of the disclosure.

Referring now to FIGS. 3*a* and 3*b*, with continued reference to FIGS. 1, 2*a*, and 2*b*. FIGS. 3*a* and 3*b* illustrate the elevator landing door system 200 and the possible gaps 292, 294 that may occur in the elevator door landing system 200. The elevator landing door system 200 may include one or more doors 220, 240. In the example of FIGS. 3*a* and 3*b*, the elevator landing door system 200 includes a first door 220 and a second door 240. A first inner side 222 of the first door 220 may become misaligned with a second inner side 242 of the second door 240, thus creating a gap 292 between the first inner side 222 and the second inner side 242. The gap 292 may be measured by a first distance D1 between the first inner side 222 and the second inner side 242. Further, a first lower side 224 of the first door 220 may become misaligned with a second lower side 244 of the second door 240, thus creating a gap 294 between the first lower side 224 and the second lower side 244. The gap 294 may be measured by a second distance D2 between the first lower side 224 and the second lower side 244.

Figure 4B:
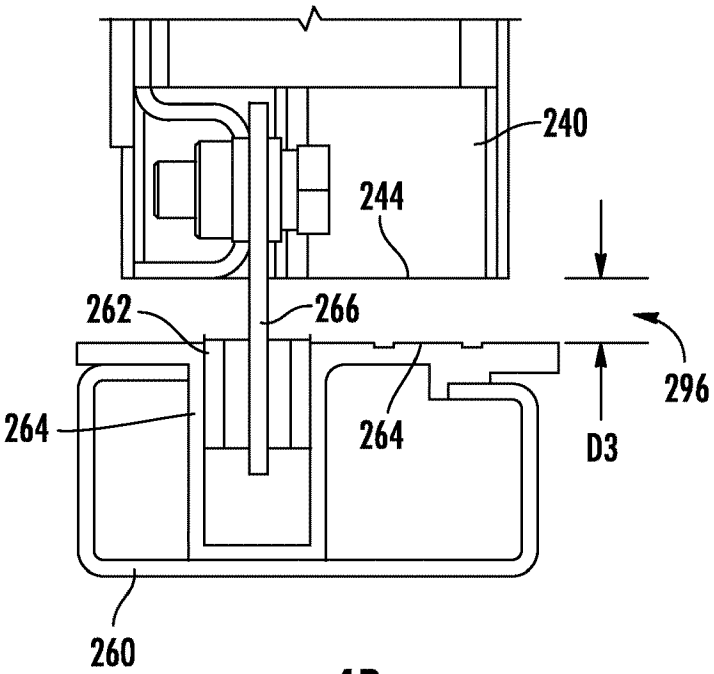
FIG. 4*b* illustrates a cut-away view of the elevator landing door system of FIG. 4*a*, in accordance with an embodiment of the disclosure.
Figure 4A:
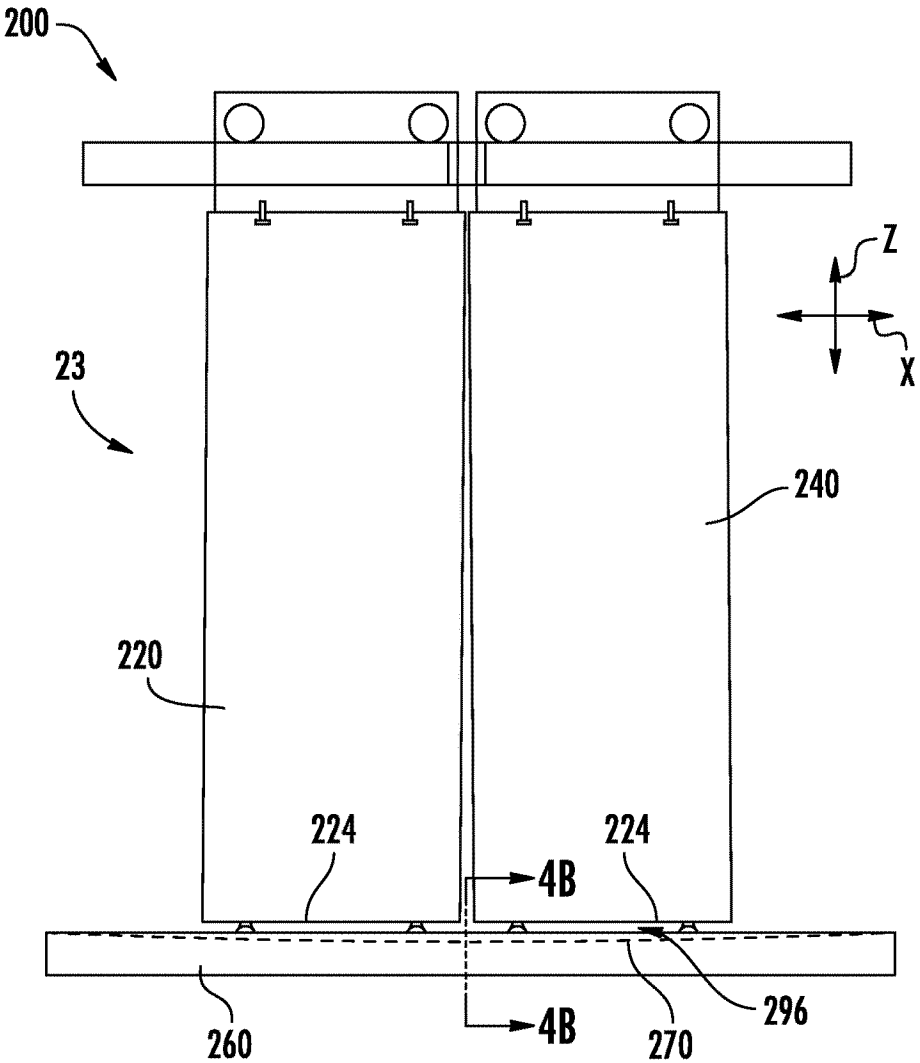
FIG. 4*a* illustrates a schematic view of an elevator landing door system, in accordance with an embodiment of the disclosure.

Referring now to FIGS. 4*a* and 4*b*, with continued reference to FIGS. 1, 2*a*, 2*b*, 3*a*, and 3*b*. FIGS. 4*a* and 4*b* illustrate the elevator landing door system 200 and a possible gap 296 that may occur in the elevator door landing system 200. The elevator landing door system 200 may include one or more doors 220, 240. In the example of FIGS. 4*a* and 4*b*, the elevator landing door system 200 includes a first door 220 and a second door 240. The elevator landing door system 200 may also include a sill 260 configured to guide the one or more elevator doors 220, 240 as they open and close. A guide 262 may be located in a track 264 of the sill 260. The guild 262 may be a gib as known by one of skill in the art. The guide 262 may be operably connected to each door 220, 240 through a link 266. The guide 262 is configured to guide each door 220, 240 along the track 264 as they open and close. The sill 260 may become bent over time due excessive weight applied to the sill 260 while loading and unloading the elevator car 23, as shown by a bend 270 in the sill 260. The bend 270 may create a gap 296 between a bottom 224, 244 of a door 220, 240 and the sill 260. The gap 296 may be measured by a third distance 296.

Figure 5:
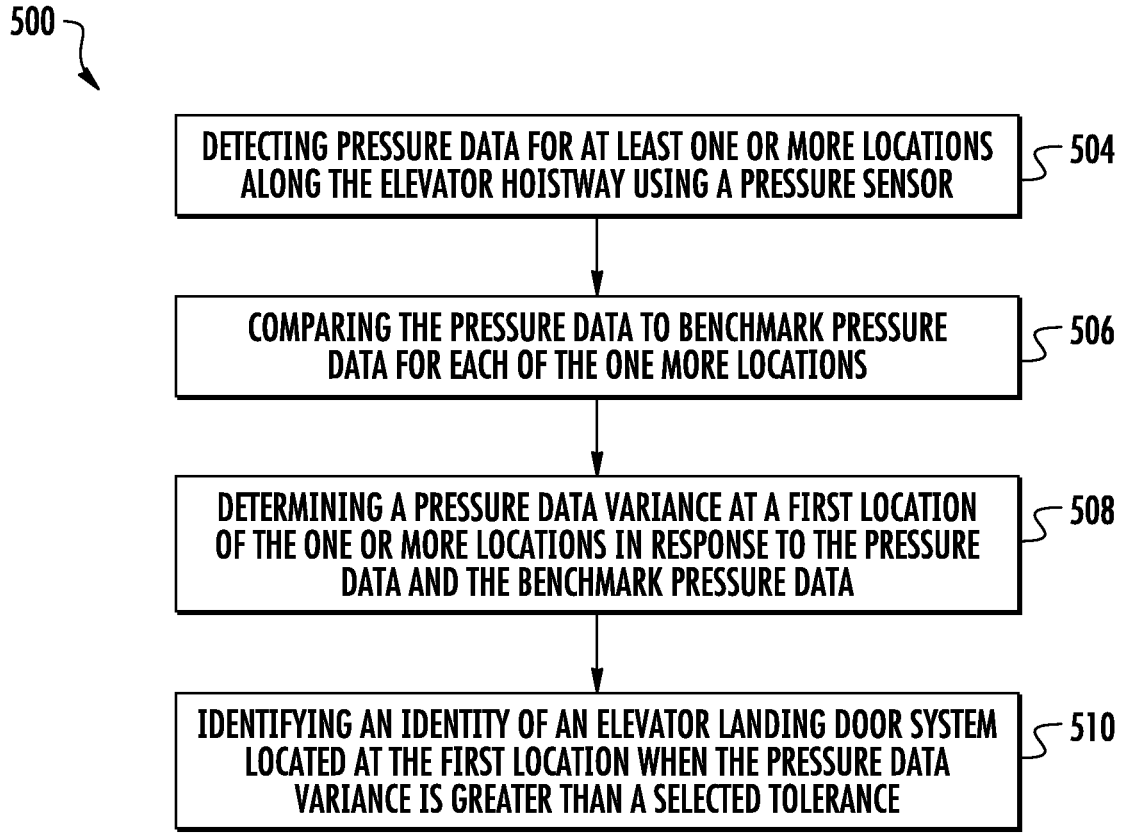
FIG. 5 is a flow chart of a method of detecting maintenance requirements of an elevator system, in accordance with an embodiment of the disclosure.

Referring now to FIG. 5, with continued reference to FIGS. 1, 2*a*, 2*b*, 3*a*, 3*b*, 4*a*, and 4*b*. FIG. 5 shows a flow chart of method 500 of detecting maintenance requirements of an elevator system 10, in accordance with an embodiment of the disclosure. At block 504, pressure data 384 for at least one or more locations along the elevator hoistway is detected using a pressure sensor 130. The method 500 may further include moving an elevator car 23 through the elevator hoistway 50, so that a pressure sensor 130 located on the elevator car 23 may detect pressure data 384 as the elevator car 23 moves through the hoistway 50 at one or more locations. Thus, the elevator car 23 may be moved simultaneously with the detection of the pressure data 386. At block 506, the pressure data 384 is compared to benchmark pressure data 384 for each of the one or more locations. At block 508, a pressure data variance 388 is determined at a first location of the one or more locations in response to the pressure data 386 and the benchmark pressure data 384. The pressure data variance 388 is a difference between the pressure data 386 and the benchmark pressure data 384.

If the pressure data variance 388 determined at the first location greater than a selected tolerance then, at block 510, an identity 390 of an elevator landing door system 200 located at the first location is identified. In one embodiment, the selected tolerance may be about 5%. In another embodiment, the selected tolerance may be about 10%. In another embodiment, the selected tolerance may be any desired value or may vary over time. The identity 390 may be transmitted to a user device 400. The pressure data 386 and/or the pressure data variance 388 may also be transmitted to a user device 400. An alarm 459 may be activated in response to identifying the elevator landing door system 200. The alarm 459 may alert an owner of the user device 400 of the identity 390 of the elevator landing door system 200 that may need to be examined. The identity 390 may include the location of the elevator landing door system 200. An alarm 559 may also be activated on each floor 80 proximate the elevator landing door system 200, as described above.

For a pressurized hoistway 50, if there are multiple identities 50 indicating multiple locations/multiple floors 80 having abnormal pressure data variances, then the entire hoistway 50 may be over pressurized or under pressurized, and air pressure may be adjusted in the hoistway 50 in response to the pressure data variance 388. For example, the fan 180 may increase or decrease activity in order to adjust the air pressure within the hoistway 50.

While the above description has described the flow process of FIG. 5 in a particular order, it should be appreciated that unless otherwise specifically required in the attached claims that the ordering of the steps may be varied.

As described above, embodiments can be in the form of processor-implemented processes and devices for practicing those processes, such as processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

It is understood that an elevator system is used for illustrative purposes and the embodiments disclosed herein may be applicable to car conveyances systems in passageways other than an elevator system, such as, for example, a subway system having a subway car that travels through a passageway (i.e. subway tunnel) having car stop location doors that open to the passageway at each location where the car stops to let passengers out.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of detecting maintenance requirements of a system for conveying a car through a passageway, the method comprising:

moving a car through the passageway;

detecting pressure data for one or more locations along the passageway using a pressure sensor mounted on an external surface of the car, each of the one or more locations being located in the passageway;

comparing the pressure data to benchmark pressure data for each of the one or more locations within the passageway;

determining a pressure data variance at a first location of the one or more locations based on comparing the pressure data to benchmark pressure data for each of the one or more locations within the passageway;

identifying an identity of a car stop location door system located at the first location when the pressure data variance is greater than a selected tolerance; and determining, using the pressure data variance, whether (i) there is a gap in a door system of the passageway when the door system is in a closed state, (ii) a fan is over pressurizing the passageway, or (iii) the fan is under pressurizing the passageway, wherein the door system is further composed of:

a first door having a first inner side and a first lower side about perpendicular to the first inner side;

a second door having a second inner side and a second lower side about perpendicular to the second inner side;

a sill having a track, the sill being located opposite the first lower side and the second lower side, the sill being in a facing spaced relationship with the first lower side and the second lower side, wherein the gap is located between:

the first inner side and the second inner side in the closed state because the first inner side is misaligned with the second inner side in the closed state;

the first lower side and the second lower side in the closed state because the first lower side is misaligned with the second lower side in the closed state; or the sill and at least one of the first lower side and the second lower side in the closed state because the sill is misaligned with at least one of the first lower side and the second lower side in the closed state.

2. The method of claim 1, wherein the moving occurs simultaneous to the detecting.

3. The method of claim 1, further comprising:

activating an alarm in response to identifying the car stop location door system.

4. The method of claim 1, further comprising:

identifying a plurality of locations having abnormal pressure variances; and determining that the fan is over pressurizing the passageway or under pressurizing the passageway based on the plurality of locations having abnormal pressure variances.

5. The method of claim 4, further comprising:

increasing air pressure in the passageway, using the fan, if the fan was determined to be under pressurizing the passageway; or decreasing air pressure in the passageway, using the fan, if the fan was determined to be over pressurizing the passageway.

6. The method of claim 1, further comprising:

transmitting at least one of the pressure data variance and the identity to a user device.

7. A method of detecting maintenance requirements of an elevator system, the method comprising:

moving an elevator car through an elevator hoistway;

detecting pressure data for one or more locations along an elevator hoistway using a pressure sensor mounted on an external surface of the elevator car, each of the one or more locations being located in the elevator hoistway;

comparing the pressure data to benchmark pressure data for each of the one or more locations within the elevator hoistway;

determining a pressure data variance at a first location of the one or more locations based on comparing the pressure data to benchmark pressure data for each of the one or more locations within the elevator hoistway;

identifying an identity of an elevator landing door system located at the first location when the pressure data variance is greater than a selected tolerance; and determining, using the pressure data variance, whether (i) there is a gap in a door system of the elevator hoistway when the door system is in a closed state, (ii) a fan is over pressurizing the elevator hoistway, or (iii) the fan is under pressurizing the elevator hoistway, wherein the door system is further composed of:

a first door having a first inner side and a first lower side about perpendicular to the first inner side;

a second door having a second inner side and a second lower side about perpendicular to the second inner side; and a sill having a track, the sill being located opposite the first lower side and the second lower side, the sill being in a facing spaced relationship with the first lower aide and the second lower side, wherein the gap is located between:

the first inner side and the second inner side in the closed state because the first inner side is misaligned with the second inner side in the closed state;

the first lower side and the second lower side in the closed state because the first lower side is misaligned with the second lower side in the closed state; or the sill and at least one of the first lower side and the second lower side in the closed state because the sill is misaligned with at least one of the first lower side and the second lower side in the closed state.

8. The method of claim 7, wherein the moving occurs simultaneous to the detecting.

9. The method of claim 7, further comprising:

activating an alarm in response to identifying the elevator landing door system.

10. The method of claim 7, further comprising:

identifying a plurality of locations having abnormal pressure variances; and determining that the fan is over pressurizing the elevator hoistway or under pressurizing the elevator hoistway based on the plurality of locations having abnormal pressure variances.

11. The method of claim 10, further comprising:

increasing air pressure in the elevator hoistway, using the fan, if the fan was determined to be under pressurizing the elevator hoistway; or decreasing air pressure in the elevator hoistway, using the fan, if the fan was determined to be over pressurizing the elevator hoistway.

12. The method of claim 7, further comprising:

transmitting at least one of the pressure data variance and the identity to a user device.

13. A controller for an elevator system, the controller comprising:

a processor; and a memory comprising computer-executable instructions that, when executed by the processor, cause the processor to perform operations, the operations comprising;

moving an elevator car through an elevator hoistway;

detecting pressure data for one or more locations along an elevator hoistway using a pressure sensor mounted on an external surface of the elevator car, each of the one or more locations being located in the elevator hoistway;

comparing the pressure data to benchmark pressure data for each of the one or more locations within the elevator hoistway;

determining a pressure data variance at a first location of the one or more locations in based on comparing the pressure data to benchmark pressure data for each of the one or more locations within the elevator hoistway;

identifying an identity of an elevator landing door system located at the first location when the pressure data variance is greater than a selected tolerance;

determining, using the pressure data variance, whether (i) there is a gap in a door system of the elevator hoistway when the door system is in a closed state, (ii) a fan is over pressurizing the elevator hoistway, or (iii) the fan is under pressurizing the elevator hoistway, wherein the door system is further composed of:

a first door having a first inner side and a first lower side about perpendicular to the first inner side;

a second door having a second inner side and a second lower side about perpendicular to the second inner side; and a sill having a track, the sill being located opposite the first lower side and the second lower side, the sill being in a facing spaced relationship with the first lower side and the second lower side, wherein the gap is located between:

the first inner side and the second inner side in the closed state because the first inner side is misaligned with the second inner side in the closed state;

the first lower side and the second lower side in the closed state because the first lower side is misaligned with the second lower side in the closed state; or the sill and at least one of the first lower side and the second lower side in the closed state because the sill is misaligned with at least one of the first lower side and the second lower side in the closed state.

14. The controller of claim 13, wherein the moving occurs simultaneous to the detecting.

15. The controller of claim 13, wherein the operations further comprise:

activating an alarm in response to identifying the elevator landing door system.

16. The controller of claim 13, wherein the operations further comprise:

identifying a plurality of locations having abnormal pressure variances; and determining that the fan is over pressurizing the elevator hoistway or under pressurizing the elevator hoistway based on the plurality of locations having abnormal pressure variances.

17. The controller of claim 16, wherein the operations further comprise:

increasing air pressure in the elevator hoistway, using the fan, if the fan was determined to be under pressurizing the elevator hoistway; or decreasing air pressure in the elevator hoistway, using the fan, if the fan was determined to be over pressurizing the elevator hoistway.

18. The method of claim 1, wherein the door system is further composed of:

a guide located in the track and operably connected to the first lower side or the second lower side.

* * * * *